United States Patent [19]

Wang

[11] Patent Number: 4,706,803

[45] Date of Patent: Nov. 17, 1987

[54] KEY SELECTOR DEVICE

[76] Inventor: Shih-Fu Wang, No. 131, Sec. 2, Kan-Yuan Street, Shu-Lin Town, Taipei County, Taiwan

[21] Appl. No.: 888,260

[22] Filed: Jul. 23, 1986

[51] Int. Cl.[4] ..... A45C 11/00

[52] U.S. Cl. ..... 206/37.1; 206/37.2; 206/37.6; 70/456 R; 70/460; 221/87

[58] Field of Search ..... 206/1.5, 37.1, 37.2, 206/37.5, 37.6, 37.7, 38.1; 70/456 R, 460; 221/87

[56] References Cited

U.S. PATENT DOCUMENTS

| | | | |
|---|---|---|---|
| 2,300,333 | 10/1942 | Barton | 221/87 |
| 2,690,666 | 10/1954 | Engel et al. | 70/456 R |
| 3,354,628 | 11/1967 | Stifelman | 206/37.2 |
| 3,457,746 | 7/1969 | Glassman | 70/456 R |
| 3,765,200 | 10/1973 | Vogt | 70/456 R |

*Primary Examiner*—Stephen P. Garbe
*Assistant Examiner*—David T. Fidei
*Attorney, Agent, or Firm*—Fleit, Jacobson, Cohn & Price

[57] ABSTRACT

A key selector device which comprises a switch means to be secured in the vicinity of the lock to be opened, and having an inners protrusion formed for pushing one of the actuating rods movably secured in alignment on the upper wall of a box, in order to enable one of the key hangers pivotably secured in alignment on a lateral axis supported by the opposing side walls of said box, to be angularly moved to a suitable position in which an enlarged triangular protrusion of said one of the key hangers which generally rests on one of the spring leaves, slides over a triangular curved portion of said one of the spring leaves secured in alignment on the rear wall of said box, while a foot portion of said one of the key hangers carrying a desired key projects upward.

3 Claims, 5 Drawing Figures

KEY SELECTOR DEVICE

BACKGROUND OF THE INVENTION

The present invention relates to a key selector device which comprises a switch means having an inner protrusion formed for pushing one of the actuating rods in order to enable one of the key hangers to be angularly moved to a suitable position in which a foot portion of said one of the key hangers carrying a desired key projects upward.

Though conventional key retainer can retain six or more than six keys in a small bag or container which is easy to carry, it still has a disadvantage i.e. it is difficult for the user to identify the keys retained in the key retainer unless the user can remember the teeth characteristics of the whole keys in a short time because most of the keys are formed in same appearance except that their teeth portions are slightly different. Even though the user can remember the teeth characteristics of the whole keys in a short time, it is still difficult for the user to find out a desired key in those retained in the same key retainer in the dark.

An object of the present invention is thus to provide a key selector device having a plurality of key hangers for use as a key retainer, and a plurality of actuating rods for effecting selection of a desired key from those retained in the same retainer in conjunction with a switch means which is to be secured in the vicinity of the lock without identifying the teeth of the key.

According to the present invention there is provided a key selector device comprising a switch means having an inner protrusion for pushing one of the actuating rods which are movably secured in alignment on the upper wall of a box, in order to enable one of the key hangers which are pivotably secured in alignment on a lateral axis which is firmly supported by the oppoosing side walls of said box, to be angularly moved to a suitable position in which an enlarged triangular protrusion end of said one of the key hangers which generally rests on one of the spring leaves, slides over a triangular curved portion of said one of the spring leaves which are secured in alignment on the rear wall of said box, while a foot portion of said one of the keys hangers carrying a desired key projects upward.

BRIEF DESCRIPTION OF THE DRAWINGS

An embodiment of the present invention will now be described by way of example with reference to the accompanying drawings in which:

Referring now to FIGS. 1–3, the key selector device of this invention comprises a substantially rectangular plastic box 1, a plurality of spring leaves 2 having an upper end secured in alignment on the rear wall 11 of the said box 1, a plurality of key hanger 3 pivotably secured in alignment on the open front end and opposing to the said spring leaves 2, a plurality of actuating rods 4 movably secured in alignment between the upper wall 13 and a partition 14 of the box 1, and opposing to the said key hanger 3, and a switch means 5 etc. The spring leaves 2 are made of an elastic sheet metal and integrally connected at the upper ends, and having a triangular curved portion 21 formed at the intermediate portion of each elastic sheet metal, and a pair of holes formed on the upper portion thereof for insertion of a pair of pins 12 which are integrally formed on the rear wall 11 of the box 1 in order that the whole spring leaves can be secured on the rear wall 11 of the box 1 by means of heat sealing of the pins 12. The key hangers 3 are made of plastic material, and having a foot portion 31 formed at the lower-most portion thereof, which is provided with a hole 35 for hanging a key (not shown) for use as a key retainer. The key hangers 3 are also provided with a lateral hole 33 for insertion of a lateral axis 34 firmly supported by the side walls of the box 1, so that the key hangers can be pivotably supported by the lateral axis 34. The key hangers 3 are also provided with an enlarged triangular protrusion end 32 having an upper slope 321 and a lower slope 322 which generally rests on the upper slope 211 of the triangular curved portion 21 of the spring leaves 2 (please refer to FIG. 3). The actuating rods are made of plastic material, and having an upper end 43 and a lower end 42 for passing through the upper wall 13 and partition 14 of the box 1 respectively, and an enlarged portion 41 integrally formed at the intermediate portion thereof, which serves as a stopper for preventing the actuating rod from being removed away from the upper wall and partition of the box, in order that the actuating rods may be movably secured in alignment between the upper wall 13 and partition 14, and opposing to the key hangers 3.

The switch means 5 is made of plastic material in a disk shape as shown in FIG. 4, and provided with an inner annular portion 51 which will be opposing to a desired actuating rod when the switch means 5 is engaged with the box 1. The switch means 5 is to be fixed on the wall near the lock which is to be opened for convenience. As shown in FIG. 5, the switch means may be formed in a box shape 5', and also provided with an inner protrusion 51' for pushing one of the actuating rods in order to enable one of the key hangers 3 to be angularly moved to a proper position in which the foot portion of the key hangers carrying a desired key projects upward.

Figure 1:
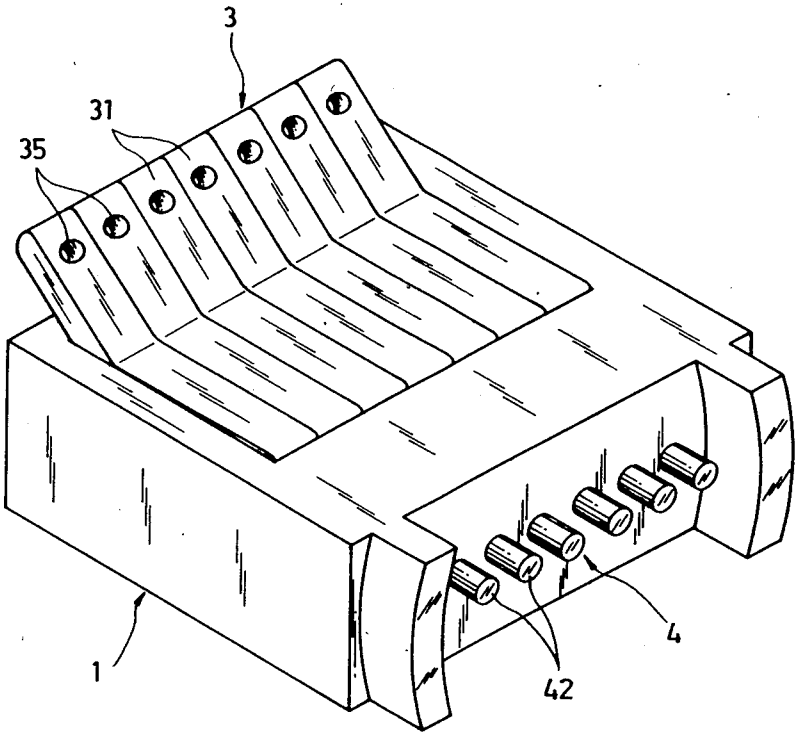
FIG. 1 is a perspective view of an embodiment of a key selector device.
Figure 2:
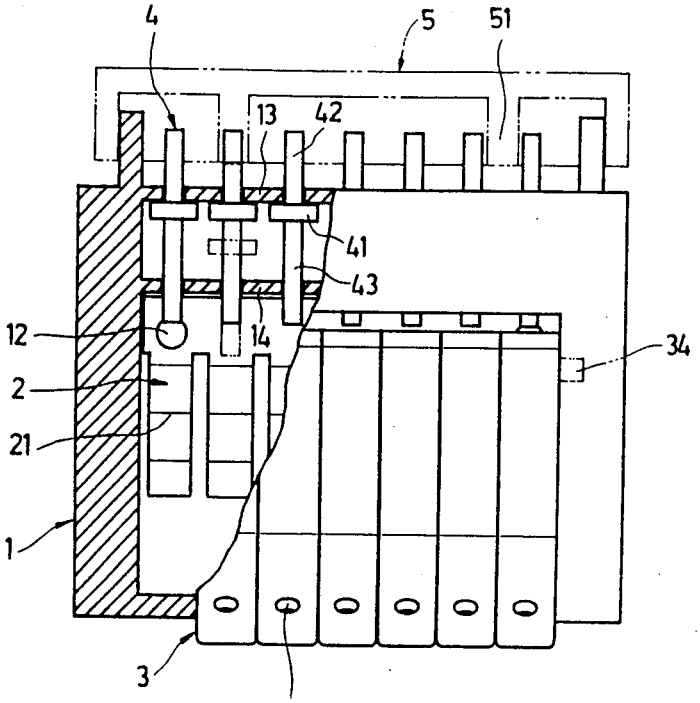
FIG. 2 is a pictorial view of an embodiment of a key selector device.
Figure 3:
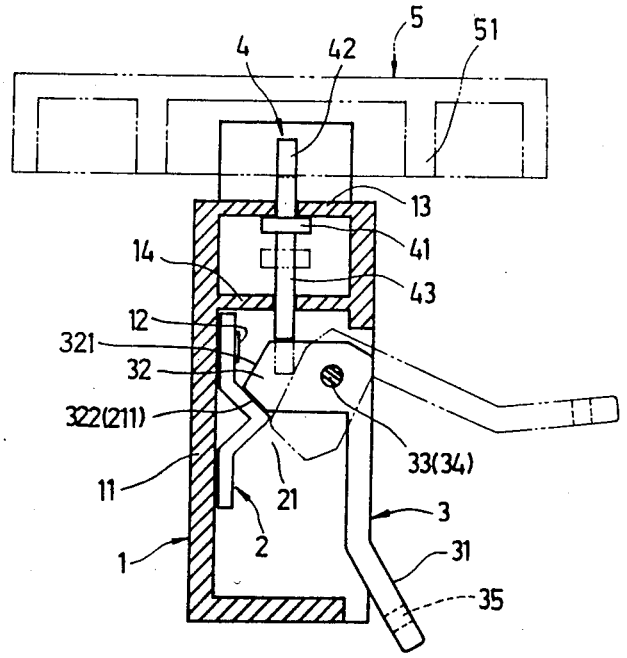
FIG. 3 is a side view of the key selector device of FIG. 2.
Figure 4:
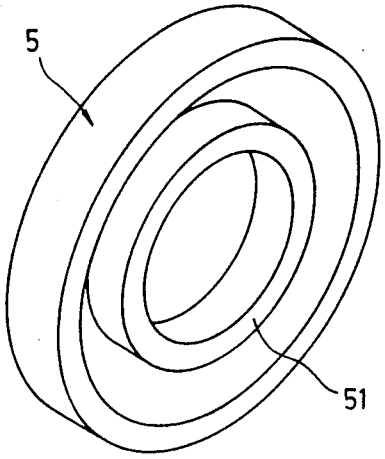
FIG. 4 is a perspective view of an embodiment of a switch means in accordance with the present invention.
Figure 5:
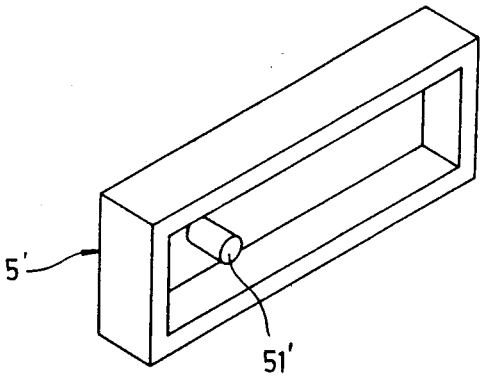
FIG. 5 is a perspective view of another embodiment of a switch means in accordance with the present invention.

The actuating rod 4 will be depressed by the inner annular portion 51 of the switch means 5, if the box 1 is engaged with the switch means 5, and a suitable force is exerted on the box. In the meanwhile, the desired one of the key hangers 3 is in turn angularly moved to a proper position in which its lower slope 322 slid over the peak of the triangular curved portion 21, and its lower foot portion end 31 projects upward as shown in phantom line of FIG. 3. Hence, a desired key can thus be obtained without identifying the teeth characteristic of the key, even though in the dark. The projecting desired key hanger 3 and corresponding actuating rod 4 will be returned to their original position if applying a suitable force on the projecting desired key hanger by means of the user's finger.

What is claimed is:

1. A key selector device, which comprises a substantially rectangular box having a rear wall, upper wall, and sidewalls, a plurality of spring leaves having an upper end secured in alignment on the rear wall of said box and having a triangular curved portion formed at the intermediate portion thereof; a plurality of key hangers opposing to said spring leaves and pivotably secured in alignment on a lateral axis firmly supported by the side walls of said box, said key hangers each has a foot portion for hanging a key, and having an enlarged triangular protrusion end formed at the rear end thereof for resting on said triangular curved portion; a plurality of actuating rods movably secured in alignment on the upper wall of said box, and opposing downward to said key hangers; and a switch means provided with an inner annular protrusion for pushing one of the actuating rods in order to enable one of said key hangers to be angularly moved to a suitable position in which said foot portion projects upward.

2. A key selector device as defined in claim 1, wherein said actuating rods each has an enlarged portion formed at the intermediate portion thereof for serving as a stopper and for preventing the actuating rod from being removed away from the upper wall of said box.

3. A key selector device as defined in claim 1, wherein said switch means is formed in a box shape, and having a inner protrusion.

* * * * *